US012798819B2

(12) United States Patent
Siegl

(10) Patent No.: US 12,798,819 B2
(45) Date of Patent: Nov. 17, 2026

(54) REUSABLE WIDE-NECKED CONTAINER AND PACKAGING UNIT

(71) Applicant: ALPLA Werke Alwin Lehner GmbH & Co. KG, Hard (AT)

(72) Inventor: Robert Siegl, Dornbirn (AT)

(73) Assignee: ALPLA Werke Alwin Lehner GmbH & Co. KG, Hard (AT)

( * ) Notice: Subject to any disclaimer, the term of this patent is extended or adjusted under 35 U.S.C. 154(b) by 0 days.

(21) Appl. No.: 18/870,084

(22) PCT Filed: May 30, 2023

(86) PCT No.: PCT/EP2023/064434

§ 371 (c)(1),
(2) Date: Nov. 27, 2024

(87) PCT Pub. No.: WO2023/232802

PCT Pub. Date: Dec. 7, 2023

(65) Prior Publication Data

US 2025/0340322 A1 Nov. 6, 2025

(30) Foreign Application Priority Data

Jun. 1, 2022 (CH) ..... CH000667/2022

(51) Int. Cl.
*B65D 1/10* (2006.01)
*B65D 1/40* (2006.01)
*B65D 41/04* (2006.01)

(52) U.S. Cl.
CPC ..... *B65D 1/10* (2013.01); *B65D 1/40* (2013.01); *B65D 41/04* (2013.01)

(58) Field of Classification Search
CPC . B65D 1/10; B65D 1/40; B65D 41/04; B65D 2543/00092; B65D 2543/00277;
(Continued)

(56) References Cited

U.S. PATENT DOCUMENTS 10,689,144 B2 * 6/2020 Siegl ..... B65D 1/16
10,793,313 B2 * 10/2020 Van Dijck ..... B65D 41/0442
(Continued)

FOREIGN PATENT DOCUMENTS

EP 2578380 A1 4/2013
FR 2049509 A6 3/1971
(Continued)

OTHER PUBLICATIONS

International Search Report Corresponding to PCT/EP2023/064434 mailed Dec. 8, 2023.
(Continued)

*Primary Examiner* — Shawn M Braden
(74) *Attorney, Agent, or Firm* — Secant IP, P.L.L.C.

(57) ABSTRACT

A reusable wide-necked container made of plastic, in particular for non-liquid, flowable filling material. The reusable wide-necked container comprises a container base, a container body and a neck. The neck has a neck section ending in an outlet opening and adjoining a container shoulder. The neck section has an inner wall and an outer wall. Securing means for securing a cover are arranged on the outer wall. The container body has an average wall thickness that is greater than 0.5 mm, in particular greater than 0.7 mm, and smaller than 1.2 mm. The neck section has a wall thickness that is greater than 1.5 mm. The neck section has a peripheral groove at the transition to the container shoulder. Also described is a packaging unit comprising a reusable wide-necked container.

14 Claims, 2 Drawing Sheets

Figure 1:
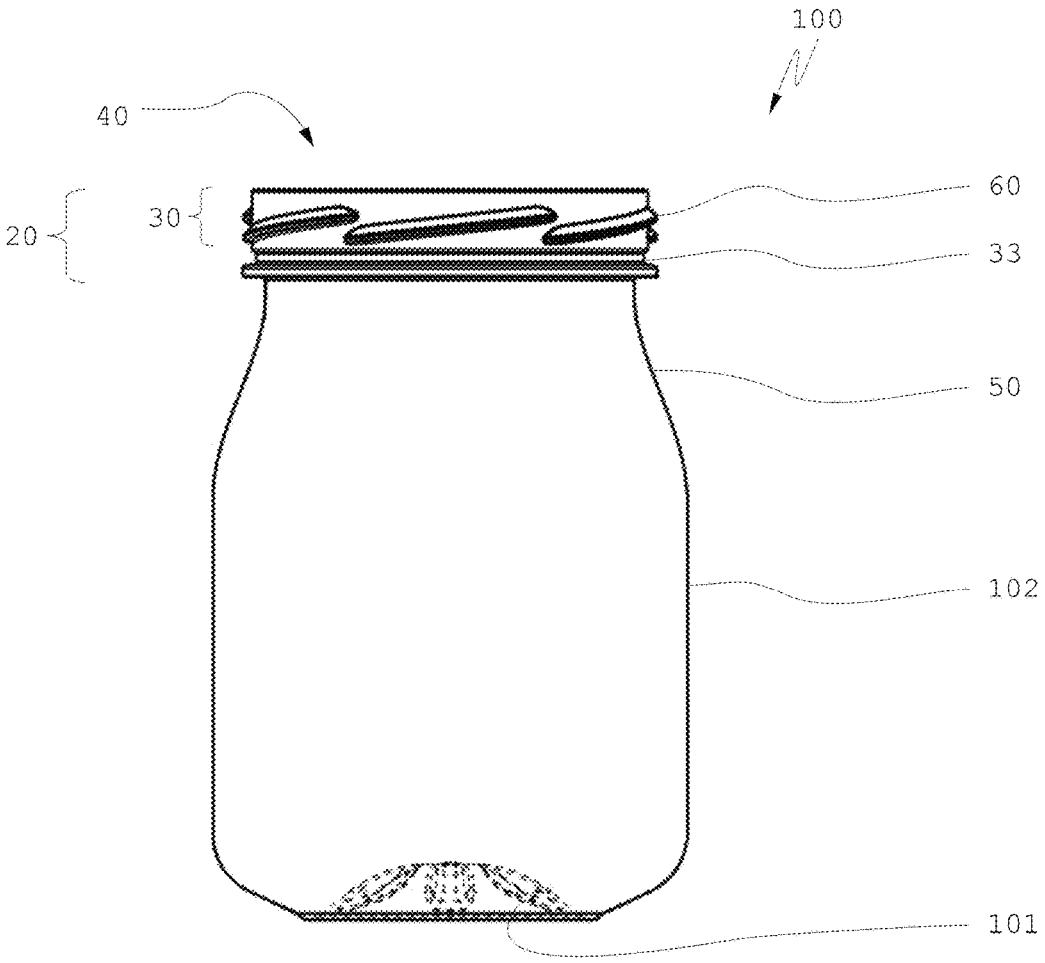

(58) Field of Classification Search
CPC ..... B65D 2543/00972; B65D 1/023; B65D 1/46; B65D 41/0442; B65D 43/0231; B65D 1/0246; B65D 43/0202; Y02W 30/80
See application file for complete search history.

(56) References Cited

U.S. PATENT DOCUMENTS

| | | | | |
|---|---|---|---|---|
| 2003/0000909 | A1 | 1/2003 | Sakaguchi et al. | |
| 2012/0187068 | A1 | 7/2012 | Fuse et al. | |
| 2013/0087943 | A1* | 4/2013 | Tsuchiya | B65D 1/0246 264/237 |
| 2013/0216748 | A1* | 8/2013 | Siegl | B29C 49/071 428/36.6 |
| 2016/0346986 | A1* | 12/2016 | Van Dijck | B29C 49/20 |
| 2022/0009667 | A1* | 1/2022 | Siegl | B65D 1/0215 |
| 2022/0324602 | A1* | 10/2022 | Avalos | B65D 1/0223 |

FOREIGN PATENT DOCUMENTS

| | | | | |
|---|---|---|---|---|
| FR | 3104555 | A1 | 6/2021 | |
| WO | WO-9903747 | A1 * | 1/1999 | B65D 41/47 |
| WO | 2014/118016 | A1 | 8/2014 | |
| WO | 2014/151032 | A1 | 9/2014 | |

OTHER PUBLICATIONS

Written Opinion Corresponding to PCT/EP2023/064434 mailed Dec. 8, 2023.

* cited by examiner

REUSABLE WIDE-NECKED CONTAINER AND PACKAGING UNIT

FIELD OF THE INVENTION

The present invention relates to a reusable wide-necked container made of plastics material, in particular for non-liquid, flowable filling material, and to a packaging unit comprising a reusable wide-necked container according to the preamble of the independent claims.

BACKGROUND OF THE INVENTION

The world's natural resources are becoming increasingly scarce as the population continues to grow. At the same time, increased demand is causing the environment to become increasingly polluted with waste. Efforts are therefore being made to either recycle or reuse used packaging.

For the latter purpose, refillable glass containers are used.

Glass packaging with a metal closure, an anti-corrosive layer for the closure, and a soft, elastic sealing compound that is arranged in the closure are common.

Glass production is not particularly precise. This results in the fact that the dimensions of the respective glass containers and in particular of the container necks and the securing means arranged thereon have a large tolerance range. These deviations can be significantly larger than 0.5 mm in diameter and in relation to a sealing surface.

This makes it necessary to provide very thick seals made of plastics material so that these tolerances can be absorbed. Typically, a soft PVC seal is used for most glass containers.

The commonly used soft PVC requires a plasticizer in order to be able to use the otherwise hard PVC as a sealant. Orthophthalates are commonly used as plasticizers that give the PVC a soft and well-sealing character.

Orthophthalates such as DEHP are suspected of being particularly harmful to health. Food packaging should under no circumstances release these orthophthalates into the contents of the glass containers, such as yogurt or jam.

Consumers are often unaware that the lid must not come into contact with the contents under any circumstances and that incorrect storage of the packaging can pose a serious risk.

In order to reuse the glass containers, they are washed. However, the washing process when washing glass is subject to certain boundary conditions. The glass containers react poorly to temperature changes. Large temperature fluctuations can cause the glass container to burst. Accordingly, glass containers can only be heated or cooled in a washing line in small temperature increments below 30° C. The same applies to a fill line.

Nevertheless, bursting containers in filling and washing lines are a recurring problem. If a single container bursts, there is a risk that entire batches of contents will be contaminated with shards. Accordingly, in such an event, entire production batches are destroyed for safety reasons. Long downtimes are incurred to clean the respective washing and filling lines.

If heated slowly, there is a risk that fungi and bacteria will change into a temperature-resistant form. The disinfecting effect of hot washing is thus reduced. Even a reduction in germs through heat in hot filling or during hot pasteurization of the contents in the packaging is not always guaranteed.

Glass packaging therefore requires very high temperatures in the washing or filling line. Both the high temperatures and the heavy weight of the glass containers are disadvantageous from an ecological point of view because a lot of energy is required to raise the total mass of the glass container to the high temperature. In addition, the heavy weight also results in increased energy costs, for example for transportation from the bottler to the retailer, from the retailer to the consumer and then from the consumer back to the retailer, who in turn returns them to the bottler, where the they are put in the washing process.

These glass containers are typically used for goods that are removed with spoons, such as yogurt or jam. But flowable goods such as oat flakes are also packaged in such containers.

These are wide-necked containers. These are characterized by the fact that they are "spoonable," i.e. a teaspoon or soup spoon can be used to remove the corresponding products.

By definition, the openings of wide-necked containers have an internal diameter that is greater than 40 mm.

It is usually provided that the openings are of a size where a corresponding lid has an outer diameter that is less than 80 mm so that it can be grasped with one hand for opening.

SUMMARY OF THE INVENTION

It is the object of the invention to eliminate one or more disadvantages of the prior art. In particular, a reusable wide-necked container is to be created that is lightweight, preferably easy and safe to seal, in particular easy to clean and preferably is highly secure against destruction.

This object is achieved by the devices defined in the independent claims. Further embodiments result from the dependent claims.

A reusable wide-necked container according to the invention is made of plastics material and is in particular provided for non-liquid, flowable filling material such as coffee, cocoa or filling material such as cream cheese, yogurt, pudding or pickled vegetables. The reusable wide-necked container comprises a container base, a container body and a neck. The neck has a neck portion that ends in an outlet opening and adjoins a container shoulder. The neck portion has an inner wall and an outer wall. Securing means for securing a lid are arranged on the outer wall. The container body has an average wall thickness that is greater than 0.5 mm, in particular greater than 0.7 mm and less than 1.2 mm, preferably between 0.9 mm and 1.0 mm. The neck portion has a wall thickness that is greater than 1.5 mm, in particular greater than 2 mm and less than 3 mm, preferably between 2.2 mm and 2.3 mm. The latter preferred values are particularly advantageous for containers having a capacity of 200 ml to 600 ml. The neck portion has a peripheral groove at the transition to the container shoulder for providing a deformable connection between the container body and the neck portion, in particular for providing a decoupling between the container body and the neck portion.

The reusable wide-necked container has in particular an outlet opening having an inner diameter that is greater than 40 mm.

Said minimum wall thicknesses characterize a reusable container, or rather distinguish a reusable container from a disposable container as it is known in the prior art.

This means that reusable containers, unlike disposable bottles or disposable cans, have much thicker walls. This results in the special problem that when deformation occurs due to the application of force, for example of the container body, not only the container body thereof is deformed, but also the neck. This is in particular true for containers that have a large opening diameter, i.e. wide-necked containers. This deformation leads to leaks between the container and an associated lid. In contrast, the container body of disposable bottles is thinner-walled, and only the container body is deformed and not the thicker-walled neck. However, thin-walled containers are not suitable for reuse.

The wall thickness of disposable containers is typically approx. 2 mm in the neck region and approx. 0.3 mm in the region of the actual container body.

A reusable wide-necked container as described here has a comparatively greater wall thickness.

The peripheral groove can prevent deformation in the neck region even in reusable wide-necked containers.

The groove is preferably arranged on an outer side of the container neck. This allows the described effect to be achieved without affecting the inner wall of the reusable wide-necked container. Arrangement on an inner wall can cause food to stick in the groove and spoil more quickly in certain circumstances.

The peripheral groove provides a point of reduced rigidity which makes it possible to decouple the container body and in particular the container shoulder from the neck of the reusable wide-necked container. Any deformation of the container body or the container shoulder is therefore not transferred to the container neck, or at most only to a lesser extent.

Providing a peripheral groove in this region causes the deformation to take place in the groove and not in the neck.

A further aspect therefore relates to the use of a peripheral groove in the container neck to reduce deformation in the neck of a reusable wide-necked container caused by a force acting on the container body, in particular the use of a peripheral groove in the container neck to decouple the container neck from the container body.

The production of the reusable wide-necked container from plastics material results in a significantly reduced weight compared to production from glass. Because the process conditions are much more adjustable and traceable compared to glass, plastics material containers can also achieve much greater accuracy in the neck and, in particular, in the securing means arranged thereon and in the dimensions of the outlet opening. This in turn makes it possible to provide seals on a container lid that require less material and therefore also release fewer hazardous substances. Due to the precision of the container neck, the fluctuations in dimensions are significantly smaller, and correspondingly fewer of these fluctuations have to be compensated for by the seal.

It is the high wall thickness that allows plastics material containers to be used multiple times. The high wall thickness result in the fact that plastics material containers are more resistant to alkalis, and stress cracks only appear later. Stress cracks occur in particular in places where stress is applied and/or deformation occurs and/or microcracks are present. Washing liquid can penetrate these weak spots and expand them until the container fails. In particular in the case of polyesters, the suds attack the ester bond and saponify it, wherein this saponification occurs very strongly in molecules that are under tension, which causes stress cracks to widen rapidly.

By decoupling the neck from the rest of the reusable wide-necked container by means of the peripheral groove, deformations and thus stresses in the region of the neck can be reduced, which leads to a longer service life of the container, in particular the neck and the securing means arranged thereon.

Decoupling also makes it possible to reduce the amount of employed materials. The high precision of the neck of the reusable wide-necked container, which remains even when the container body is deformed, leads to the fact that corresponding seals have to cover smaller tolerances and can be manufactured correspondingly smaller.

This also leads to the fact that the neck of the reusable wide-necked container can be manufactured with dimensions that are smaller, i.e. thinner-walled, in comparison to necks of reusable wide-necked containers of the prior art. This is due to reduced force input into the neck during deformation.

The peripheral groove can have a wall thickness that is less than 1.2 mm and greater than 0.5 mm. Preferably, the wall thickness is less than 0.7 mm and greater than 0.5 mm. Alternatively, the wall thickness can be less than 1.2 mm and greater than 0.8 mm. These wall thicknesses, which are smaller in comparison to the adjacent wall thicknesses, make it possible to decouple a force flow or a deformation that occurs in the region of the container body or the container shoulder from the container neck. The groove can act as a kind of joint. The wall thickness of 0.8 mm to 1.2 mm ensures that the neck is sufficiently stable during filling.

The container base can have a wall thickness that is greater than 1 mm and less than 3 mm. Because container bases are usually not well stretched, bending stresses occur that usually cause the bases to deform outward. By the appropriate choice of wall thickness, these stresses can be distributed better.

The groove can have a width that is greater than 1 mm, preferably greater than 1.8 mm, in particular greater than 2.1 mm and less than 3 mm. The minimum width of 1 mm ensures that the container neck is sufficiently decoupled from the container body. The maximum width ensures that the reusable wide-necked container does not become unstable.

The width of the groove is the dimension of the groove in an axial direction of the reusable wide-necked container, i.e. in the direction of a longitudinal axis. The longitudinal axis is typically defined by a connection between a base of a container and its outlet opening. For round containers, this coincides with an axis of rotation.

The width of the groove is particularly important. The wider it is, the greater deformations it can absorb since it can deform over a longer distance.

As explained, in this configuration, the wall thickness of the container neck can be reduced. This means that the wall thickness is closer to the wall thickness of the container body. This basically means that the container neck would deform significantly more if a force were to be applied to the container body. This relationship can be counteracted by arranging a peripheral groove. This makes it possible to largely avoid or at least reduce deformation of the container neck, even when the wall thickness of the container neck and the container body are similar. This effect is particularly evident with wall thickness ratios between the container body and the container neck of 1.25 to 3. This includes all combinations of the values described here. The wall thickness ratio is preferably 2.2 to 2.6.

A support ring can be arranged between the groove and the container shoulder. The support ring makes it possible to grasp the reusable wide-necked container during the production process. In addition, it provides an element of increased rigidity, and part of a force that acts on the container shoulder or the container body can be absorbed in the support ring, which already leads to a reduction in deformation in the support ring. The arrangement can also be reversed. The groove is then arranged between the support ring and the container shoulder; the support ring is therefore arranged above the groove. This creates a reinforcement in the container neck which is thus less sensitive to deformation.

The securing means for securing a lid can be designed as a multi-start thread. The number of threads is at least six and is preferably more than six. Due to this high number of threads, the force applied by a lid to the container neck when closing the reusable wide-necked container can be distributed over a large number of individual points. The force application is therefore more uniform, and any deformations also occur more uniformly and are reduced.

It is preferably provided that the force is applied over all the thread turns rather than over the entire surface of the respective flanks of the threads.

Preferably, there are fewer than twelve threads, in particular between eight and ten.

For example, in the case of a container neck that has only two threads, all of the force that is required to seal the container is applied at just two points. In this example, said points are typically diametrically opposed to each other, and a container neck is effectively pulled upward at these two points while closing, and the container neck accordingly deforms and/or develops stresses which, in combination with suds, lead to cracks.

By using six or more threads, this effect can be prevented or at least reduced to such an extent that deformation no longer plays a significant role. If the deformations are small, the required sealing compound in the lid can also be reduced, because only significantly smaller tolerances would have to be compensated for.

Alternatively, the securing means for securing a lid can, however, also be designed as a single-start thread. A single-start thread makes it possible to apply force over the entire length of the thread. A single-start thread also requires a single-start thread on the counterpart, i.e. the lid. This is preferably designed to surround more than 360°, and correspondingly, the force for sealing and closing can be applied evenly over the entire circumference of an opening of the reusable wide-necked container.

A sealing surface having a support surface for a seal can be arranged at the outlet opening of the reusable wide-necked container. Said support surface can have a width that is greater than 1.5 mm and less than 4 mm, in particular less than 3 mm.

Because the reusable wide-necked container is made of plastics material, it is typically unavoidable that damage occurs in the region of the outlet opening. Damage can occur in particular by using the reusable wide-necked container, for example when inserting spoons, forks or knives to remove a product.

Above all, the minimum width of the support surface ensures however that damage does not extend across the entire width of the support surface and that sealing is therefore still guaranteed.

The maximum width prevents excessive accumulation of tolerances that occur, for example, due to deformation or also during production. For example, a certain angular deviation, depending on the length of the path over which it occurs, leads to an excessively large difference in relation to other dimensions, such as height.

A further aspect relates to a packaging unit comprising a reusable wide-necked container comprising a container base, a container body and a neck, wherein the neck has a neck portion that ends in an outlet opening and adjoins a container shoulder. In particular, the container comprises a reusable wide-necked container as described herein. The packaging unit also comprises a lid for closing the reusable wide-necked container. A seal is arranged in the lid, wherein said seal has a sealing surface having a width that is greater than 1.5 mm.

The width of the sealing surface ensures that any harm or damage to the counterpart can be reliably sealed even after its occurrence.

It can be provided that the seal is engaged or can be brought into engagement along at least a region of an inner wall and/or an outer wall of the neck portion, so that it at least partially encloses an edge of the outlet opening. Typically, there is a corresponding sealing surface having a support surface on the edge of the outlet opening. By accordingly extending the seals along the inner wall and/or the outer wall, this sealing surface can be enclosed, and the sealing effect is supplemented by an axial component. In other words, the seal also extends partially in an axial direction.

Preferably, the seal can extend 0.8 mm to 2.5 mm in the axial direction and accordingly cover the inner wall and/or outer wall over this length. The sealing effect can thus be increased.

On the one hand, this enclosure improves the sealing function. If the upper sealing surface or support surface is damaged, the axial component continues to ensure the sealing effect. On the other hand, the enclosure stabilizes the container mouth as the outlet opening on the container neck. If forces are applied that would deform the container in this mouth, the enclosure will hold it in its sealing round shape.

This effect is additional and reinforces the sealing effect when using a reusable wide-necked container as described here. This has a decoupling effect caused by a peripheral groove, which reduces the force applied to the container neck.

The lid can have engagement means for engaging a multi-start thread having six or more threads. The engagement means can accordingly apply a force to be applied at a plurality of points on the reusable wide-necked container and thus break force peaks. Accordingly, deformations in the region of force application are reduced.

It can be provided that the engagement means are designed as a thread complementary to the multi-start thread. Due to the complementary design, the force can be applied not only at points, but over the entire length of the respective thread portions. The force application is thus additionally homogenized.

The seal can comprise, in particular consist of soft, flexible material. The material can be selected from the list of foamed plastics materials, elastomers, petroleum-based plastics materials or bio-based plastics materials. In particular, thermoplastic elastomers (TPE) or ethylene propylene diene rubber (EPDM) can be used.

The reusable wide-necked container can be made of a PET copolymer, wherein the PET copolymer has a copolymer content of 0.5% to 10%. Preferred copolymers are diethylene glycol, isophthalic acid, CHDM, furandicarboxylic acid or NDC. Alternative additives are cyclohexanedimethanol CHDM or naphthalenedicarboxylic acid NDC.

The reusable wide-necked container is preferably a container that is manufactured in a stretch blow molding process from a preform produced using an injection molding process.

The neck of the preform is not stretched, but the remaining region of the preform is stretched axially and radially.

The peripheral groove is preferably located in the region of the reusable wide-necked container that is not stretched.

BRIEF DESCRIPTION OF THE DRAWING(S)

Figure 2:
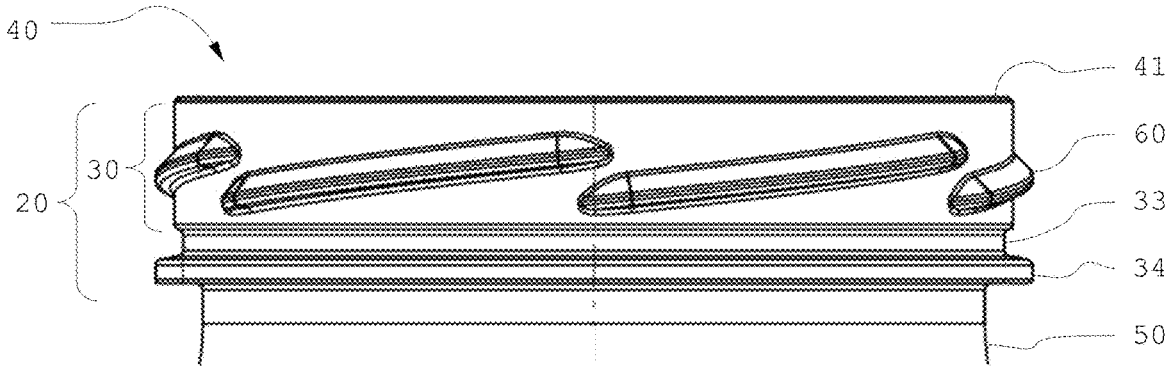
Figure 3:
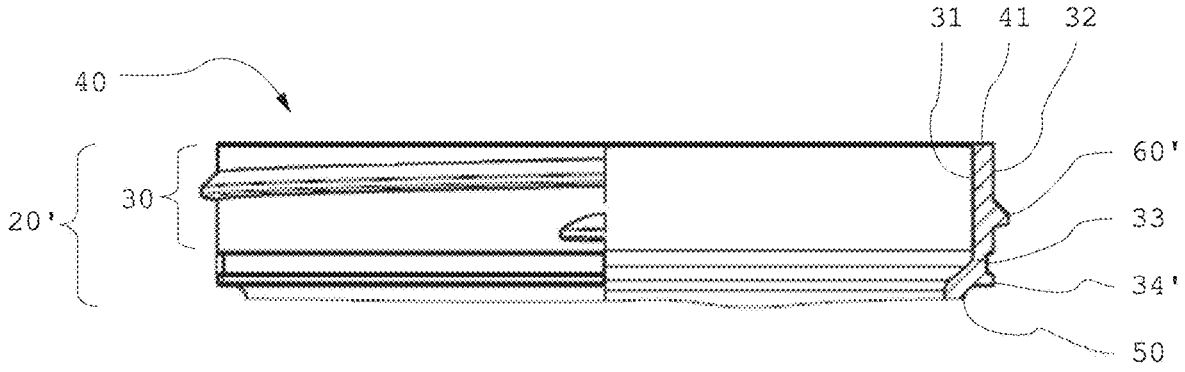
Figure 4A:
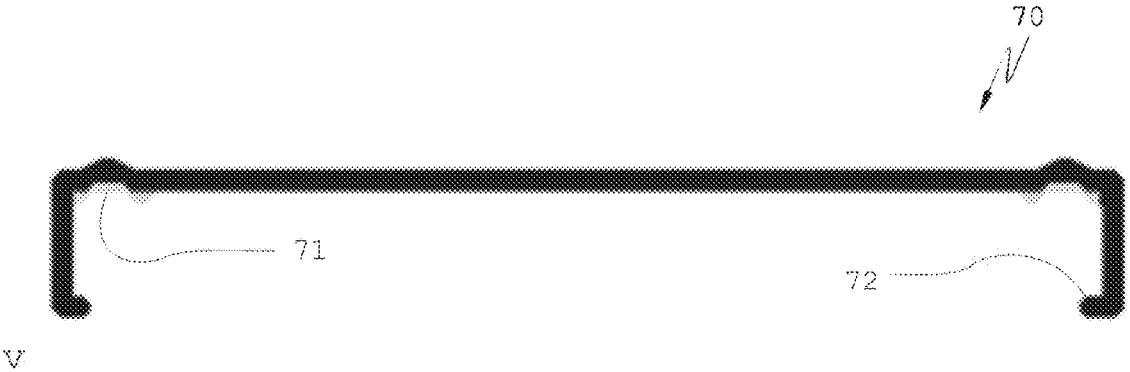
Figure 4B:
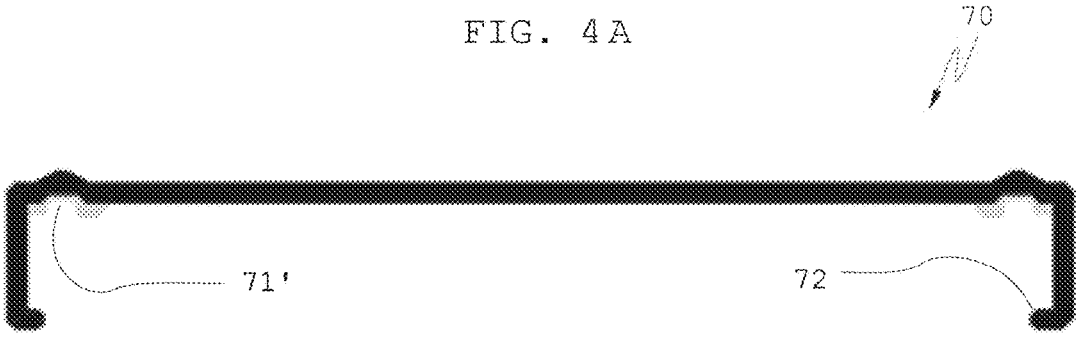
Figure 4C:
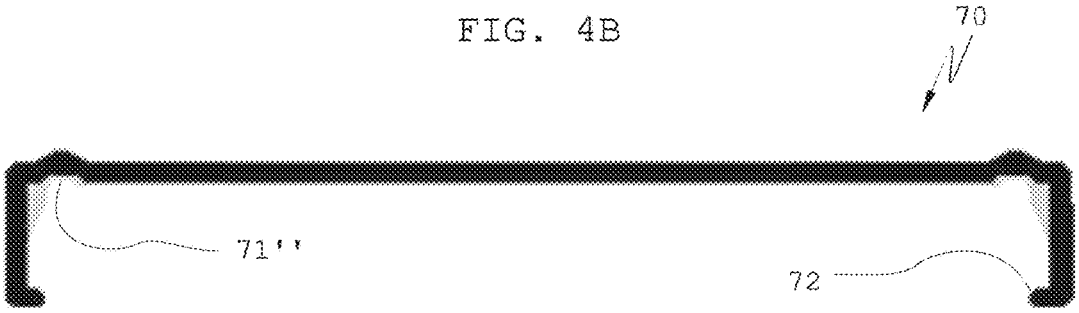

The invention is explained below with reference to schematic figures. In the figures:

FIG. 1: shows a reusable wide-necked container;

FIG. 2: shows the neck of the reusable wide-necked container according to FIG. 1;

FIG. 3: shows an alternative neck;

FIG. 4A to 4C: show different lids.

DETAILED DESCRIPTION OF THE INVENTION

FIG. 1 shows a reusable wide-necked container 100. Said reusable wide-necked container comprises a container base 101, a container body 102 and an adjoining container shoulder 50. A neck 20 adjoins the container shoulder 50. The neck 20 comprises a neck portion 30 on which securing means 60 are arranged. The neck portion 30 has an inner wall 31 and an outer wall 32 (see FIG. 3). The securing means 60 are arranged on the outer wall 32. The securing means 60 are provided to secure a lid 70 (see FIG. 4). The neck portion 30 ends in an outlet opening 40. The inner diameter of the outlet opening 40 is in the present case greater than 40 mm and thus corresponds to the configuration of a wide-necked container.

FIG. 2 shows the neck 20 of the reusable wide-necked container 100 according to FIG. 1. It can be seen that securing means 60 for securing a lid are arranged on the outer wall 32 of the neck portion 30. The securing means 60 are designed as a multi-start thread, wherein in the present case, said thread comprises six thread turns.

The neck portion 30 is part of a neck 20 that adjoins a container shoulder 50. A groove 33 is arranged between the neck portion 30 and the container shoulder 50. The groove 33 has a reduced wall thickness in relation to the neck portion 30. The groove 33 adjoins a support ring 34 which in turn adjoins the container shoulder 50. In other words, in the present embodiment according to FIG. 2, the neck 20 comprises the neck portion 30, the groove 33 and the support ring 34. As can be seen from FIG. 2, the transitions between the neck portion 30, the groove 33, the support ring 34 and the container shoulder 50 are each formed with radii. These radii are between 0.2 mm and 0.8 mm. The neck portion 30 ends in an outlet opening 40. A sealing surface is arranged at this outlet opening. The sealing surface has a support surface 41 that is wider than 1.5 mm (see also FIG. 3). In the present case, the support surface 41 is arranged substantially horizontally in its intended use and has an overall circular ring-shaped construction.

FIG. 3 shows an alternative embodiment of a neck 20', analogous to the neck 20 according to FIG. 2, wherein the illustration is partially cut away. The neck 20' also has a neck portion 30 that has an inner wall 31 and an outer wall 32. Fastening means 60' are arranged on the outer wall 32 for attaching a lid. In the present case, the securing means 60' are designed as a single-start thread. The neck portion 30 ends on the one hand in the outlet opening 40 and on the other hand in a peripheral groove 33. The sealing surface having the support surface 41 is designed analogously to the embodiment according to FIG. 2.

A support ring 34' is arranged below the groove 33, i.e. between the groove 33 and a container shoulder 50. The support ring 34' is significantly less pronounced in comparison to the support ring 34 in FIG. 2. Due to the constriction of the container neck 50, the support ring 34' still provides a sufficiently large surface to allow handling of the reusable wide-necked container. It goes without saying that the securing means 60 and 60' as well as the support ring 34 and 34' can be freely combined with one another in all embodiments.

FIG. 4A to 4C show cross sections of lids 70 with different seal designs. FIG. 4A shows a seal 71 that is designed such that it completely covers a support surface 41 (see FIG. 3) and slightly overlaps it at the sides. The seal 71' according to FIG. 4B is more pronounced. Said seal 71' is substantially U-shaped. In other words, the seal 71' overlaps an inner wall 31 and an outer wall 32 (see FIG. 3) over a certain distance so that the neck portion 30 is encompassed and sealed from three sides in the region of the support surface 41. FIG. 4C shows an alternative embodiment of a seal 71", wherein it extends significantly further beyond an outer wall 32 at its periphery. This embodiment is significantly less susceptible to cracks or harm or damage, in particular at the transition of the outer wall 32 to the support surface 41 of the neck portion 30.

The invention claimed is:

1. A reusable wide-necked container (100) made of plastics material, in particular for non-liquid, flowable filling material, comprising a container base (101), a container body (102) and a neck (20), wherein the neck (20) has a neck portion (30) ending in an outlet opening (40) and adjoining a container shoulder (50), wherein the neck portion (30) has an inner wall (31) and an outer wall (32), wherein securing means (60) for securing a lid (70) are arranged on the outer wall (32), wherein the container body (102) has an average wall thickness (W) that is greater than 0.5 mm and less than 1.2 mm, and in that the neck portion has a wall thickness (H) that is greater than 1.5 mm, and less than 3 mm, wherein the neck portion has a peripheral groove (33) at the transition to the container shoulder (50) for providing a deformable connection between the container body and the neck portion and wherein the peripheral groove (33) has a wall thickness that is less than 1.2 mm and greater than 0.5 mm.

2. The reusable wide-necked container (100) according to claim 1, wherein the peripheral groove (33) has a wall thickness that is less than 0.7 mm and greater than 0.5 mm.

3. The reusable wide-necked container (100) according to claim 1, wherein the peripheral groove (33) has a wall thickness that is less than 1.2 mm and greater than 0.8 mm.

4. The reusable wide-necked container (100) according to claim 1, wherein the container base (101) has a wall thickness (B) that is greater than 1 mm and less than 3 mm.

5. The reusable wide-necked container (100) according to claim 1, wherein the groove (33) has a width that is greater than 1 mm and less than 3 mm.

6. The reusable wide-necked container (100) according to claim 1, wherein a support ring (34) is arranged between the peripheral groove (33) and the container shoulder.

7. The reusable wide-necked container (100) according to claim 1, wherein the securing means (60) for securing the lid (70) are designed as a multi-start thread, wherein the number of thread turns is greater than 6.

8. The reusable wide-necked container (100) according to claim 1, wherein the securing means (60) for securing the lid (70) are designed as a single-start thread.

9. The reusable wide-necked container (100) according to claim 1, wherein a sealing surface having a support surface (41) for a seal is arranged on the outlet opening (40), wherein said support surface (41) has a width that is greater than 1.5 mm and less than 4 mm.

10. A packaging unit (200) comprising: a reusable wide-necked container (100) according to claim 1, further comprising a lid (70) for closing the reusable wide-necked container (100), wherein a seal (71) is arranged in the lid (70), wherein the seal (71) has a sealing surface having a width that is greater than 1.5 mm.

11. The packaging unit (200) according to claim 10, wherein the seal (71) is engaged or can be brought into engagement along at least a region of an inner wall (31) and/or an outer wall (32) of the neck portion (30).

12. The packaging unit (200) according to claim 10, wherein the lid (70) has engagement means (72) for engaging in a multi-start thread having six or more thread turns.

13. The packaging unit (200) according to claim 12, wherein the engagement means (72) are designed as a thread complementary to the multi-start thread.

14. The packaging unit (200) according to claim 10, wherein the seal comprises, a soft, flexible material, wherein said material is selected from the list of foamed plastics materials, elastomers, petroleum-based plastics materials, bio-based plastics materials, a thermoplastic elastomer (TPE), or ethylene propylene diene rubber (EPDM).

* * * * *